US005429898A

United States Patent [19]

Sugizaki et al.

[11] Patent Number: 5,429,898

[45] Date of Patent: Jul. 4, 1995

[54] BLACK TONER INCLUDING A KESINOUS COMPONENT FOR FORMING AN IMAGE AND IMAGING PROCESS

[75] Inventors: Yutaka Sugizaki; Yasuo Yamamoto; Taichi Yamada; Masaki Nakamura, all of Minami Ashigara; Yasuhiro Uehara, Ebina; Yasuhiro Kusumoto, Ebina; Yasuhiro Oda, Ebina, all of Japan

[73] Assignee: Fuji Xerox Co., Ltd., Tokyo, Japan

[21] Appl. No.: 149,278

[22] Filed: Nov. 9, 1993

[30] Foreign Application Priority Data

Nov. 11, 1992 [JP] Japan ..... 4-324705

[51] Int. Cl.[6] ..... G03G 9/08

[52] U.S. Cl. ..... 430/45; 430/106

[58] Field of Search ..... 430/109, 106, 110, 45

[56] References Cited

U.S. PATENT DOCUMENTS 5,306,589 4/1994 Yamamoto et al. ..... 430/109
5,310,812 5/1994 Yasuda et al. ..... 430/109
5,312,704 5/1994 Fuller et al. ..... 430/109

FOREIGN PATENT DOCUMENTS 62-195679 8/1987 Japan .
2-293867 12/1990 Japan .
3-2765 1/1991 Japan .

*Primary Examiner*—John Goodrow
*Attorney, Agent, or Firm*—Oliff & Berridge

[57] ABSTRACT

A method for forming an image with a copying machine capable of both color copying and black-and-white copying is disclosed, in which a black toner contains at least a colorant and a resinous component having a weight average molecular weight (Mw) of from 25,000 to 80,000 and a number average molecular weight (Mn) of from 2,000 to 8,000, with a Mw/Mn ratio being not less than 10, and having an apparent melt viscosity of $1\times10^4$ poise at a temperature between 115° C. and 140° C. as measured by a flow tester method, and the quantity of heat of fixing is varied between a B/W mode and a color mode.

16 Claims, 1 Drawing Sheet

BLACK TONER INCLUDING A KESINOUS COMPONENT FOR FORMING AN IMAGE AND IMAGING PROCESS

FIELD OF THE INVENTION

This invention relates to a method of image formation using a black toner in a copying machine capable of providing both a black-and-white copy image and a full color copy image. More particularly, it relates to a method of forming a satisfactory black-and-white image as well as a full color image with a digital color copying machine.

BACKGROUND OF THE INVENTION

In a conventional digital full color copying machine, toner designing and setting of fixing conditions are made primarily in pursuit of color image formation as described in JP-A-2-293867 and JP-A-3-2765 (the term "JP-A" as used herein means an "unexamined published Japanese patent application"). Therefore, when the copying machine is applied to a black-and-white (hereinafter abbreviated as B/W) original, a black toner is excessively fused only to provide a B/W image rich in gloss as in the case of a full color mode.

Since a B/W image is generally desired to have low surface gloss, i.e., so-called matt finish, it has been difficult to broaden the market for a digital full color copying machine in offices where copying machines are used exclusively for copying of B/W images. Accordingly, there has been a keen demand for development of a digital full color copying machine with which matt B/W images are obtained.

It is known that gloss of a fixed image may be reduced by controlling molecular weight distribution of the polymer used in a toner to thereby control the viscoelasticity of the toner. However, mere control of the viscoelasticity of the toner as has been adopted in conventional electrophotographic techniques fails to obtain full color images rich in gloss. Besides, fusion of such a toner with controlled viscoelasticity is insufficient, causing a reduction in color developability and a reduction in light transmission of the resulting image formed on an OHP sheet.

SUMMARY OF THE INVENTION

An object of the present invention is to provide a method for forming an image using a black toner with a digital full color copying machine, in which a full color image with high gloss and satisfactory color developability can be formed in a full color mode and, on the other hand, a matt B/W image with low gloss can be formed in a B/W mode.

As a result of extensive investigations, the present inventors have found that the above object of the present invention can be accomplished by using a specific black toner and by changing the quantity of heat of fixing between a B/W mode and a color mode and thus completed the present invention.

The present invention relates to a method for forming an image with a copying machine capable of both color copying and B/W copying, in which a black toner contains at least a colorant and a resinous component having a weight average molecular weight (hereinafter abbreviated as Mw) of from 25,000 to 80,000 and a number average molecular weight (hereinafter abbreviated as Mn) of from 2,000 to 8,000 with an Mw/Mn ratio of not less than 10 and having an apparent melt viscosity of $1\times10^4$ poise at a temperature between 115° C. and 140° C. as measured by a flow tester method, and the quantity of heat of fixing is varied between a B/W copying and a color copying.

In a preferred embodiment of the present invention, the fixing conditions for the fixation of a B/W toner image and for the fixiation of a color toner image satisfy the relationship:

$$T_1\times t_1\times 1.5 \leqq T_2\times t_2$$

wherein $T_1$ represents a nip retention time (msec) in heat fixing in the B/W copying; $t_1$ represents a temperature (K) of a heat roll in the B/W copying; $T_2$ represents a nip retention time (msec) in heat fixing in the color copying; $t_2$ represents a temperature (K) of a heat roll in color copying.

In another preferred embodiment of the present invention, the resinous component of the black toner is a polyester resin having no tetrahydrofuran-insoluble content which is obtained by polycondensation of a polyhydric alcohol and a polybasic carboxylic acid.

The words "having no tetrahydrofuran-insoluble content" herein used should not be interpreted to exclude any inclusion of tetrahydrofuran-insoluble content, and the tetrahydrofuran-insoluble content may be included to an extent that tetrahydrofuran-insoluble content (solid content) is not observed by naked eyes when Soxhet extraction is conducted using tetrahydrofuran.

DETAILED DESCRIPTION OF THE INVENTION

Figure 1:
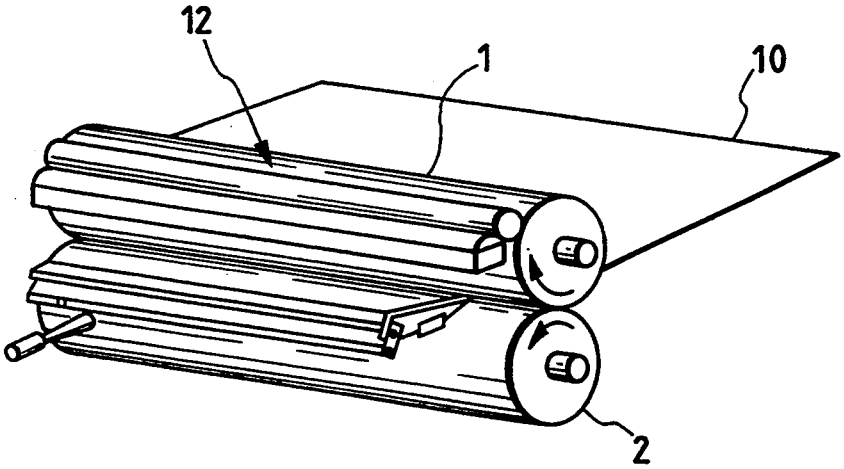
FIG. 1 is a perspective view of a fixing apparatus which can be used in the present invention.

In the present invention, the temperature at which the apparent melt viscosity of the black toner reaches $1\times10^4$ poise (hereinafter referred to as T) was determined by a flow tester method. The measurement was conducted with Flow Tester CFT500-A manufactured by Shimazu Seisakusho under the following conditions.

Die: 0.5 mm×1.0 mm
Rate of temperature rise: 5° C./min
Load: 10 kg
Preheating time: 300 sec
Measuring temperature: 80° to 190° C.

Measurement of the molecular weight of the resinous component constituting the black toner was conducted by gel-permeation chromatography using an automatic high-temperature high-speed chromatograph ("Waters ALC/GPC 150C" manufactured by Waters Co.) under the following conditions.

Solvent: tetrahydrofuran (hereinafter abbreviated as THF)
Flow rate: 1.0 ml/min
Temperature: 40° C.
Detector: differential refractometer (RI)

The black toner which can be used in the present invention comprises at least a colorant and a binder resin, with the resinous component thereof having an Mw of from 25,000 to 80,000 and an Mn of from 2,000 to 8,000 with an Mw/Mn ratio of not less than 10 and having an apparent melt viscosity of $1\times10^4$ poise at a temperature between 115° C. and 140° C. as measured by a flow tester method.

If the Mw of the resinous component exceeds 80,000, the black area of a full color image tends to have insufficient gloss. If it is less than 25,000, a B/W image becomes too glossy. If the Mn is greater than 8,000, the fixing temperature becomes the higher. If it is less than 2,000, the toner has poor preservability. If the Mw/Mn ratio, indicative of the molecular weight distribution, is less than 10, offset is apt to occur in high temperatures. It T is lower than 115° C., a B/W image becomes too glossy. If it is higher than 140° C., the black area of a full color image tends to have insufficient gloss.

The binder resin which can be used in the black toner of the present invention is conventional. Usable binder resins include a homo- or copolymer of styrene or a derivative thereof (e.g., vinyltoluene, α-methyltoluene, chlorostyrene or aminostyrene), a homo- or copolymer of methacrylic acid or an ester thereof (e.g., methyl methacrylate, ethyl methacrylate or butyl methacrylate), a homo- or copolymer of acrylic acid or an ester thereof (e.g., methyl acrylate, ethyl acrylate, butyl acrylate or 2-ethylhexyl acrylate), a homopolymer of a diene (e.g., butadiene or isoprene) or a vinyl monomer (e.g., acrylonitrile, a vinyl ether, maleic anhydride, vinyl chloride or vinyl acetate) or a copolymer of such a diene or vinyl monomer and other copolymerizable monomers, polyamide resins, polyester resins, polyurethane resins, and so forth. Preferred of them are polyester resins. These binder resins may be used either individually or in combination of two or more thereof.

The polyester resins as binder resins are prepared by polycondensation of a polyhydric alcohol and a polybasic carboxylic acid. Examples of the-polyhydric alcohols include diols, e.g., ethylene glycol, diethylene glycol, triethylene glycol, 1,2-propylene glycol, 1,3-propylene glycol, 1,4-butanediol, neopentyl glycol, 1,4-butenediol, and cyclohexanedimethanol; hydrogenated bisphenol A; alkylene oxide adducts of bisphenol A, e.g., polyoxyethylene-added bisphenol A and polyoxypropylene-added bisphenol A; and other dihydric alcohols. Additionally, trimethylolpropane, 1,3,5-trihydroxymethylbenzene and other polyhydric alcohols may also be used.

Examples of the polybasic carboxylic acids include maleic acid, fumaric acid, mesaconic acid, citraconic acid, itaconic acid, glutaconic acid, terephthalic acid, isophthalic acid, cyclohexanedicarboxylic acid, succinic acid, adipic acid, sebacic acid, malonic acid, alkylsuccinic acids, anhydrides or alkyl esters of these carboxylic acids, and other dibasic carboxylic acids.

These carboxylic acids may be used in combination with a tri- or higher hydric alcohol and/or a tri- or higher basic carboxylic acid so as to make the resulting polymer non-linear to such an extent that no THF-insoluble content may occur. The tri- or higher hydric alcohol and the tri- or higher basic carboxylic acid are used in an amount of 30 mol% or less, preferably 25 mol% or less of the total amount of the carboxylic acids and alcohol used.

Examples of such a polyhydric alcohol are sorbitol, 1,2,3,6-hexanetetrol, 1,4-sorbitan, pentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of such a polybasic carboxylic acid are 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, and 1,2,4-butanetricarboxylic acid.

Polyester resins having substantially no THF-insoluble content (gel content) are preferred because a full color image tends to have insufficient gloss in the presence of a THF-insoluble content of the binder resin. Use of a polyester binder resin with no gel content makes it possible to achieve both a high gloss in a color mode and a low gloss in a B/W mode.

It is more preferred that the above-mentioned polyester resins obtained from a polyhydric alcohol and a polybasic carboxylic acid further contains a component derived from alkenylsuccinic acid anhydride as a cross-linking component. Preferred examples of the alkenylsuccinic acid include n-butenylsuccinic acid, isobutenylsuccinic acid, n-octenylsuccinic acid, n-dodecenylsuccinic acid and isododecenylsuccinic acid. Of them, n-dodecenylsuccinic acid is most preferred. The alkenylsuccinic acid anhydride is preferably contained in an amount of not more than 50 mol%, more preferably 5 to 45 mol%, most preferably 10 to 30 mol% of the total amount of acid component of the polyester. The dodecenylsuccinic acid anhydride is a tri-basic cross-linking component having a $C_{12}$ alkyl group. Existence of the alkenylsuccinic acid anhydride component makes it possible to provide a binder resin having a higher molecular weight and a reduced softening point with which offset can be prevented.

A mixture of a linear polyester resin and a non-linear polyester resin may be used as a binder resin for a black toner. By adjusting the linear polyester to non-linear polyester mixing ratio, the molecular weight and molecular weight distribution of the toner can be controlled freely.

The colorant which can be used in the black toner of the present invention includes carbon black having an average primary particle size of less than 50 mμ and not less than 35 mμ. If in using carbon black whose average primary particle size is smaller than 35 mμ, the toner tends to have a red tint, which is unfavorable in full color copying. Carbon black particles having an average primary particle size of 50 mμ or greater have insufficient dispersibility in a toner only to provide a toner having deteriorated charging characteristics.

The colorant is used in an amount of from 2 to 10 parts by weight per 100 parts by weight of the resin of a black toner. If the amount of the colorant is less than 2 parts, the toner has insufficient coloring power. If it exceeds 10 parts, gradation reproducibility of the image is reduced.

Color toners which can be used together with the above-mentioned black toner are conventional full color toners using a polyester resin as a binder resin. Colorants known for full color toners, such as Monoazo Yellow, carmine, quinacridone, rhodamine, copper phthalocyanine, etc., can be employed. These colorants are preferably subjected to flushing so as to have improved dispersibility.

The image formation method using a digital color copying machine according to the present invention comprises forming a latent image on a photoreceptor in a usual manner, developing the latent image with a toner to form a toner image, transferring the toner image to a transfer sheet, and fixing the transferred image under heat, wherein the quantity of heat for fixing is varied between a B/W copying and a color copying.

Figure 2:
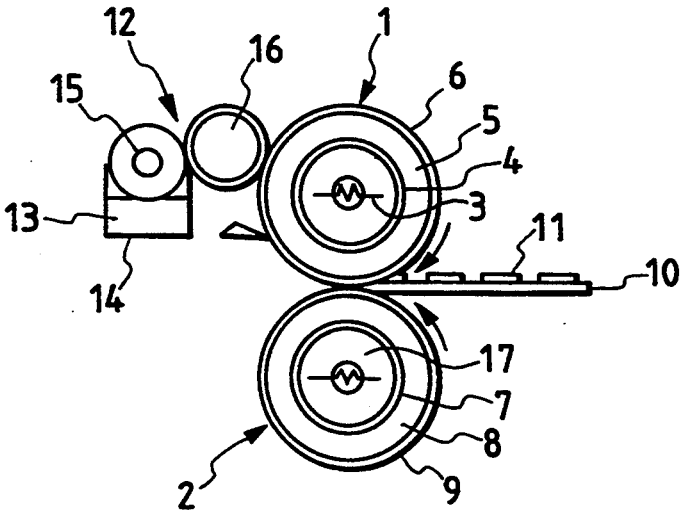
FIG. 2 is a cross section of the fixing apparatus of FIG. 1.

FIGS. 1 and 2 illustrate a perspective view and a cross sectional view, respectively, of a heat-fixing apparatus which can be preferably used in the present invention.

The fixing apparatus shown in FIGS. 1 and 2 is composed mainly of heat roll 1 and pressure roll 2 contacting each other under pressure. Heat roll 1 is composed of base roll 4 containing internal heat source 3, inner elastic layer 5, and outer elastic layer 6. Pressure roll 2 is composed of base roll 7 containing internal heat source 17, inner elastic layer 8, and outer elastic layer 9.

Parting agent feeder 12 is provided on the periphery of at least one of heat roll 1 and pressure roll 2 in such a manner that silicone composition 13 in oil pan 14 may be picked up by fountain roll 15 and supplied to coating roll 16 which is in contact with heat roll 1. Numerals 10 and 11 indicate a sheet of transfer paper and a toner, respectively.

Base roll 4 or 7 is required to have rigidity as well as sufficient heat conductivity for conducting heat energy from internal heat source 3 or 17 to inner elastic layer 5 or 8. More specifically, base roll 4 or 7 is made of a metallic material, such as a stainless alloy, aluminum, etc. Inner elastic layer 5 or 8 is required to have sufficient elasticity and sufficient thickness enough to bring heat roll 1 and pressure roll 2 into contact under a moderate pressure with an appropriate contact width as well as sufficient heat conductivity for conducting the heat energy from the heat source to outer elastic layer 6 or 9. More specifically, inner elastic layer 5 or 8 is made of an elastomer, such as a fluorosilicone elastomer, a silicone elastomer, various other silicone rubbers, a fluorocarbon elastomer, various organic rubbers (e.g., an ethylene-propylene-diene rubber), or various copolymers, having dispersed therein a metal-containing filler. The elastomer constituting inner elastic layer 5 or 8 has a rubber hardness of up to 80° according to a JIS hardness. In general, the elastomer having dispersed therein a filler has the JIS rubber hardness of from 40° to 70°.

Outer elastic layer 6 or 9 formed on inner elastic layer 5 or 8, respectively, is required to have high heat conductivity enough to conduct the heat energy from heat source 3 or 17 to toner image 11 formed on transfer paper 10, affinity to a parting agent for offset prevention, i.e., silicone composition 13, and abrasion resistance. Suitable materials for these layers include a fluoroelastomer and a silicone elastomer. Specific examples of the fluoroelastomer include a vinylidene fluoride-hexafluoropropylene copolymer (sold by E. I. du Pont under a trade name of Viton A); a vinylidene fluoride-hexafluoropropylene-tetrafluoroethylene terpolymer (sold by E. I. du Pont under a trade name of Viton B); Fluorel 2170, 2174, 2176, 2177 or IVS76 (sold by 3M Co.); and Viton GH, EGOC or E430 (sold by E. I. du Pont). Specific examples of the silicone elastomers include high-temperature curing types (HTV), room-temperature curing types (RTV), and low-temperature curing type (LTV). In the case of using a silicone elastomer, it is preferable to provide an oil-resistant layer between the outer elastic layer and the inner elastic layer for preventing a parting agent from penetrating into the inner elastic layer. A mixture of a vinylidene fluoride-based fluoroelastomer and other materials, e.g., tetrafluoroethylene, silicone rubber or fluorosilicone rubber, may also be used as an outer elastic layer.

The metal-containing filler which can be used for adjustment of heat conductivity includes copper, tin, silver, zinc, aluminum, iron, lead, molybdenum, platinum, gold, beryllium, nickel, chromium, iridium, ruthenium, tungsten, cadmium, vanadium, and alloys, oxides or salts of these metals.

Where the above-described black toner and fixing apparatus are used for copying in a digital color copying machine, it is possible to control the surface gloss of a fixed image simply by controlling the roll speed during fixing without changing the set temperatures of the heat roll and the pressure roll. That is, B/W copying can be carried out with the fixing roll speed being set high (e.g., 200 mm/sec in terms of surface speed), and color copying can be carried out by setting the fixing roll speed low (e.g., 100 mm/sec in terms of surface speed) while setting the heat roll and the pressure roll at the same temperatures as those used in the B/W mode. In this way, a B/W image with low surface gloss quiet to the eyes can be obtained in a B/W mode and, on the other hand, a full color image with high surface gloss and vivid colors can be obtained by applying sufficient heat to the toner in a full color mode.

The present invention will now be illustrated in greater detail with reference to Examples, but the present invention should not be construed as being limited thereto. All the parts and percents are by weight unless otherwise specified.

EXAMPLE 1

Preparation of Black Toner:

| | |
|---|---|
| Non-linear bisphenol type polyester (bisphenol A-ethylene oxide adduct/ bisphenol A-propylene oxide adduct/ terephthalic acid/trimellitic anhydride condensate; Mw: 83,000; Mn: 3,600; Mw/Mn: 23; THF-insoluble content: 0%; T: 130° C.) (hereinafter referred to as Polyester A) | 100 parts |
| Carbon black (average primary particle size: 45 mμ) | 4 parts |

The above components were melt-kneaded in an extruder. After cooling, the composition was ground in a jet mill followed by classification to prepare a black toner having a volume average particle size of 7 μm. The molecular weight and molecular weight distribution of the resinous component constituting the resulting toner are shown in Table 1 below. T of the black toner is also shown in the Table.

EXAMPLE 2

| | |
|---|---|
| Polyester A | 90 parts |
| Linear bisphenol type polyester (bisphenol A-propylene oxide adduct/ fumaric acid condensate; Mw: 13,000; Mn: 2,700; Mw/Mn: 4.8; T: 105° C.) (hereinafter referred to as Polyester B) | 10 parts |
| Carbon black (average primary particle size: 45 mμ) | 4 parts |

A black toner (average particle size: 7 μm) was prepared from the above components in the same manner as in Example 1. The molecular weight and molecular weight distribution of the resinous component constituting the resulting toner are shown in Table 1 below. T of the black toner is also shown in the Table.

EXAMPLE 3

| | |
|---|---|
| Polyester A | 50 parts |

-continued

| | |
|---|---|
| Polyester B | 50 parts |
| Carbon black (average primary particle size: 45 mμ) | 4 parts |

A black toner (average particle size: 7 μm) was prepared from the above components in the same manner as in Example 1. The molecular weight and molecular weight distribution of the resinous component constituting the resulting toner are shown in Table 1 below. T of the black toner is also shown in the Table.

EXAMPLE 4

| | |
|---|---|
| Non-linear bisphenol type polyester (bisphenol A-ethylene oxide adduct/ bisphenol A-ethylene oxide adduct propylene oxide adduct/terephthalic acid/dodecenylsuccinic acid/tri-mellitic anhydride condensate; Mw: 92,000; Mn: 3,500; Mw/Mn: 26.0; THF-insoluble content: 0%; T: 125° C.) (hereinafter referred to as Polyester C) | 100 parts |
| Carbon black (average primary particle size: 45 mμ) | 4 parts |

A black toner (average particle size: 7 μm) was prepared from the above components in the same manner as in Example 1. The molecular weight and molecular weight distribution of the resinous component constituting the resulting toner are shown in Table 1 below. T of the black toner is also shown in the Table.

EXAMPLE 5

| | |
|---|---|
| Polyester C | 70 parts |
| Polyester B | 30 parts |
| Carbon black (average primary particle size: 45 mμ) | 4 parts |

A black toner (average particle size: 7 μm) was prepared from the above components in the same manner as in Example 1. The molecular weight and molecular weight distribution of the resinous component constituting the resulting toner are shown in Table 1 below. T of the black toner is also shown in the Table.

COMPARATIVE EXAMPLE 1

| | |
|---|---|
| Polyester A | 30 parts |
| Polyester B | 70 parts |
| Carbon black (average primary particle size: 45 mμ) | 4 parts |

A black toner (average particle size: 7 μm) was prepared from the above components in the same manner as in Example 1. The molecular weight and molecular weight distribution of the resinous component constituting the resulting toner are shown in Table 1 below. T of the black toner is also shown in the Table.

COMPARATIVE EXAMPLE 2

| | |
|---|---|
| Polyester B | 100 parts |
| Carbon black (average primary particle size: 45 mμ) | 4 parts |

A black toner (average particle size: 7 μm) was prepared from the above components in the same manner as in Example 1. The molecular weight and molecular weight distribution of the resinous component constituting the resulting toner are shown in Table 1 below. T of the black toner is also shown in the Table.

Image Formation:

Each of the black toners prepared in Examples 1 to 5 and Comparative Examples 1 to 2 was mixed with hydrophobic silica (R 972, produced by Nippon Aerosil Co., Ltd.) in a high-speed rotary mixer, and the blend was further mixed with an acrylic polymer-coated ferrite carrier having a particle size of 50 μm to prepare a developer. A digital full color copying machine (a remodeled machine of "Acolor", manufactured by Fuji Xerox Co., Ltd.) was loaded with the developer, and a non-fixed toner image was formed on transfer paper.

Fixing of Toner Image:

A fixing machine having the following construction was used. Reference is made to FIG. 2.

Heat roll 1 is composed of cored base roll 4 made of aluminum having an outer diameter of 43 mm which contains therein 500W quartz lamp 3, 3.0 mm thick inner elastic layer 5 provided on base roll 4 via an appropriate primer which is made of a compound comprising 100 parts of a silicone compound (SH841U produced by Toray Industries, Inc.), 100 parts of crystalline silica, and 0.8 part of a vulcanizing agent (RC-4, produced by Toray Industries, Inc.) and has a heat conductivity λ of 0.0017 cal/cm-sec-deg and a rubber hardness (JIS) of 60°, and 20 μm thick outer elastic layer 6 formed on inner elastic layer 5 which is made of a compound comprising 100 parts of a Viton rubber (E-60C, produced by E. I. du Pont), 2 parts of carbon (produced by Tokyo Zairyo K. K.), and 10 parts of magnesium oxide (MgO #30, produced by Kyowa Chemical Industry Co., Ltd.) and has a heat conductivity λ of 0.0005 cal/cm-sec-deg.

Pressure roll 2 is composed of cored base roll 7 having an outer diameter of 49 mm and made of aluminum containing therein 500W quartz lamp 17, 1.0 mm thick inner elastic layer 8 formed on base roll 7 via an appropriate primer which is made of a compound comprising 100 parts of a silicone compound (SH841U), 50 parts of crystalline silica, and 0.8 part of a vulcanizing agent (RC-4) and has a heat conductivity λ of 0.0015 cal/cm-sec-deg and a rubber hardness (JIS) of 70°, and 20 μm thick outer elastic layer 9 formed on inner elastic layer 8 which is made of a compound comprising 100 parts of a Viton rubber (E-60C), 2 parts of carbon (produced by Tokyo Zairyo K. K.), and 10 parts of magnesium oxide (MgO #30) and has a heat conductivity λ of 0.0005 cal/cm-sec-deg.

Heat roll 1 and pressure roll 2 are in contact with each other under pressure by means of a pressing mechanism (not shown) to have a nip width (contact width) of 6.0 mm. The surface temperature of heat roll 1 and pressure roll 2 is set at 155° C. ($t_1=t_2=423K$) and 150° C., respectively. The two rolls are set to revolve to the opposite directions as indicated by the arrows each at a surface speed of 200 mm/sec in a B/W mode and 100 mm/sec in a color mode.

The non-fixed toner image was subjected to heat-fixing using the above-illustrated fixing machine under the following conditions.

The nip retention time in a B/W mode ($T_1$) was set at 30 msec while that in a color mode ($T_2$) at 60 msec. Accordingly, the relationship between the fixing conditions in a B/W mode to those in a color mode is represented by:

$$T_1 \times t_1 \times 1.5 = 19035 \leqq T_2 \times t_2 = 25380$$

Evaluation:

The resulting fixed image was evaluated according to the following test methods. The results obtained are shown in Table 2 below.

1) Minimum Fixing Temperature ($Tf_{min}$):

The fixed image was rubbed under a given load. The fixing temperature at which 70% or more of the fixed image remained after the rubbing was taken as a minimum fixing temperature ($Tf_{min}$).

2) Gloss:

The gloss of the fixed image was measured with a glossmeter (Glossguard II, manufactured by Gardner Corp., U.S.A.) at an incident angle of 75°.

TABLE 1

| Example No. | Toner Composition (part) Polyester A | Polyester B | Polyester C | Carbon Black | Molecular Weight of Toner Mw | Mn | Mw/Mn (°C.) | T |
|---|---|---|---|---|---|---|---|---|
| Example 1 | 100 | 0 | 0 | 4 | 54,400 | 2,400 | 22.7 | 126 |
| Example 2 | 90 | 10 | 0 | 4 | 43,300 | 2,300 | 18.6 | 124 |
| Example 3 | 50 | 50 | 0 | 4 | 30,000 | 2,600 | 11.5 | 120 |
| Example 4 | 0 | 0 | 100 | 4 | 62,000 | 2,800 | 22.1 | 123 |
| Example 5 | 0 | 30 | 70 | 4 | 38,000 | 2,300 | 16.5 | 118 |
| Comparative Example 1 | 30 | 70 | 0 | 4 | 23,000 | 2,300 | 10 | 112 |
| Comparative Example 2 | 0 | 100 | 0 | 4 | 13,500 | 2,500 | 6.6 | 105 |

TABLE 2

| Example No. | Color Mode* $Tf_{min}$ (°C.) | Gloss (%) | B/W Mode** $Tf_{min}$ (°C.) | Gloss (%) |
|---|---|---|---|---|
| Example 1 | 125 | 50 | 145 | 15 |
| Example 2 | 117 | 70 | 145 | 19 |
| Example 3 | 117 | 73 | 140 | 29 |
| Example 4 | 122 | 47 | 142 | 12 |
| Example 5 | 116 | 71 | 140 | 20 |
| Comparative Example 1 | 115 | 78 | 138 | 35 |
| Comparative Example 2 | 113 | 83 | 135 | 75 |

Note:
*Fixing speed: 100 mm/sec
**Fixing speed: 200 mm/sec

As is apparent from the results in Table 2, the toners of Examples 1 to 3 furnished a quiet B/W image of relatively low gloss (not more than 30%) in a B/W mode while providing a vivid color image with a gloss as high as 50% or more. To the contrary, the toners of Comparative Examples 1 and 2 failed to produce a B/W or color image with a desired gloss in the respective mode.

EXAMPLE 6

Preparation of Flushed Pigment:

| | |
|---|---|
| Polyester B | 100 parts |
| Water-containing paste of cyan pigment (C.I. Pigment Blue 15:3; water content: 20%) | 54 parts |

The above components were melt-kneaded in a pressure kneader while displacing the water content of the water-containing pigment paste with the polyester to prepare a cyan flushed pigment having a cyan pigment content of 30% (hereinafter designated as pigment a).

Preparation of Full Color Toner:

| | |
|---|---|
| Polyester B | 100 parts |
| Cyan flushed pigment a | 15.5 parts |

The above components were melt-kneaded in a pressure kneader, cooled, and ground in a jet mill, followed by classification to prepare a cyan toner having a volume average particle size of 7 μm.

EXAMPLE 7

Preparation of Flushed Pigment:

A magenta flushed pigment b (pigment content: 30%) was prepared in the same manner as in Example 6, except for replacing the cyan pigment water-containing paste with a water-containing paste of a magenta pigment (C. I. Pigment Red 57:1).

Preparation of Full Color Toner:

A magenta toner (volume average particle size: 7 μm) was prepared in the same manner as in Example 6, except for replacing cyan flushed pigment a with magenta flushed pigment b.

EXAMPLE 8

Preparation of Flushed Pigment:

A yellow flushed pigment c (pigment content: 30%) was prepared in the same manner as in Example 6, except for replacing the cyan pigment water-containing paste with a water-containing paste of a yellow pigment (C. I. Pigment Yellow 97).

Preparation of Full Color Toner:

A yellow toner (volume average particle size: 7 μm) was prepared in the same manner as in Example 6, except for replacing cyan flushed pigment a with yellow flushed pigment c.

Image Formation:

Each of the cyan, magenta and yellow toners prepared in Examples 6 to 8 were mixed with hydrophobic silica (R 972) in a high-speed rotary mixer, and the blend was further mixed with a methylene/methyl methacrylate polymer-coated ferrite carrier to prepare a developer.

The developer containing each of the black toners prepared in Examples 1 to 3 was combined with the above-prepared color developers, and full color copies were taken using the resulting full color developer system on a digital full color copying machine (a remodeled machine of "Acolor") at a fixing speed of 100 mm/sec. There were obtained clear and vivid full color images rich in gloss, indicating sufficient fusion of the black toner as well as the other color toners.

According to the image formation method of the present invention, a full color image with high gloss can be obtained with satisfactory color developability in a full color mode while a matt B/W image with low gloss can be obtained in a B/W mode.

While the invention has been described in detail and with reference to specific examples thereof, it will be apparent to one skilled in the art that various changes and modifications can be made therein without departing from the spirit and scope thereof.

What is claimed is:

1. A method for forming an image with a copying machine capable of both color copying and black-and-white copying, wherein a black toner to be used contains (i) at least a colorant, and (ii) a resinous component having a weight average molecular weight (Mw) of from 25,000 to 80,000 and a number average molecular weight (Mn) of from 2,000 to 8,000, with a ratio of the weight average molecular weight to the number average molecular weight (Mw/Mn) being not less than 10, and having an apparent melt viscosity of $1\times10^{-4}$ poise at a temperature between 115° C. and 140° C. as measured by a flow tester method, and wherein the quantity of heat to be applied for fixation differs between the color copying and the black-and-white copying, and the colorant comprises from 2 to 10 parts by weight of said resinous component and whereby the toner is capable of producing color images with high gloss and black and white images with low gloss.

2. The method as claimed in claim 1, wherein said resinous component contains a polyester binder resin having no tetrahydrofuran-insoluble content, which is obtained by polycondensation of a polyhydric alcohol and a polybasic carboxylic acid.

3. The method as claimed in claim 1, wherein said colorant is carbon black having a particle size of less than 50 mμ and not less than 35 mμ.

4. The method as claimed in claim 1, wherein the difference in the quantity of heat is effected by changing the number or revolution of a heat roll and a pressure roll which are provided as a fixing means in the copying machine.

5. The method as claimed in claim 1, wherein conditions for the fixation of a black-and-white toner image and for the fixation of a color toner image satisfy the following relationship:

$$T_1\times t_1\times 1.5\leqq T_2\times t_2$$

wherein $T_1$ represents a nip retention time (msec) in heat fixing in the black-and-white copying; $t_1$ represents a temperature (K) of a heat roll in the black-and-white copying; $T_2$ represents a nip retention time (msec) in heat fixing in the color copying; $t_2$ represents a temperature (K) of a heat roll in the color copying.

6. A black toner for forming both color images and black-and-white images, comprising (i) at least a colorant, and (ii) a resinous component having a weight average molecular weight (Mw) of from 25,000 to 80,000 and a number average molecular weight (Mn) of from 2,000 to 8,000, with a ratio of the weight average molecular weight to the number average molecular weight (Mw/Mn) being not less than 10, and having an apparent melt viscosity of $1\times10^{-4}$ poise at a temperature between 115° C. and 140° C. as measured by a flow tester method, wherein said binder resinous component contains a polyester binder resin having no tetrahydrofuran-insoluble content, which is obtained by polycondensation of a polyhydric alcohol and polybasic carboxylic acid, wherein the colorant comprises from 2 to 10 parts by weight of said resinous component.

7. The black toner as claimed in claim 6, wherein said polyester binder resin further contains a component derived from alkenylsuccinic acid anhydride.

8. A black toner for forming both color images and black-and-white images, comprising (i) at least a colorant, and (ii) a resinous component having a weight average molecular weight (Mw) of from 25,000 to 80,000 and a number average molecular weight (Mn) of from 2,000 to 8,000, with a ratio of the weight average molecular weight to the number average molecular weight (Mw/Mn) being not less than 10, and having an apparent melt viscosity of $1\times10^{-4}$ poise at a temperature between 115° C. and 140° C. as measured by a flow tester method, wherein the colorant comprises from 2 to 10 parts by weight of said resinous component.

9. The black toner according to claim 8, wherein said resinous binder is selected from the group consisting of a homo- or copolymer of styrene or derivative thereof, a homo- or copolymer of methacrylic acid or an ester thereof, a homo- or copolymer of acrylic acid or an ester thereof, a homopolymer of a diene, a vinyl monomer, a copolymer of a diene or vinyl monomer and other copolymerizable monomers, a polyamide resin, a polyester resin, a polyurethane resin and a mixture thereof.

10. The black toner according to claim 9, wherein said resinous binder comprises a polyester resin.

11. The black toner according to claim 10, wherein said polyester resin is obtained by polycondensation of:

a polyhydric alcohol selected from the group consisting of ethylene glycol, diethylene glycol, triethylene glycol, 1,2 -propylene glycol, 1,3-propylene glycol, 1,4-butanediol, neopentyl glycol, 1,4-butenediol, cyclohexanedimethanol, hydrogenated bisphenol A, alkylene oxide adducts of bisphenol A, trimethylolpropane and 1,3,5-trihydroxymethylbenzene; and a polybasic carboxylic acid selected from the group consisting of maleic acid, fumaric acid, mesaconic acid, citraconic acid, itaconic acid, glutaconic acid, terephthalic acid, isophthalic acid, cyclohexanedicarboxylic acid, succinic acid, adipic acid, sebacic acid, malonic acid, alkylsuccinic acids and anhydrides or alkyl esters thereof.

12. The black toner according to claim 11, wherein said polyester resin has no tetrahydrofuran-insoluble content and is obtained by using in combination with said carboxylic acid a member selected from the group consisting of tri- or higher polyhydric alcohol, tri- or higher basic carboxylic acid and mixtures thereof.

13. The black toner according to claim 12, wherein said tri- or higher polyhydric alcohol is selected from the group consisting of sorbitol, 1,2,3,6-hexanetetrol, 1,4-sorbitan, pentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

14. The black toner according to claim 12, wherein said tri- or higher polybasic carboxylic acid is selected from the group consisting of 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, and 1,2,4-butanetricarboxylic acid.

15. The black toner according to claim 12, wherein said tri- or higher polyhydric alcohol and said tri- or higher polybasic carboxylic acid are used in an amount of 30 mol% or less of the total amount of said carboxylic acid and alcohol.

16. The black toner according to claim 8, wherein said colorant is carbon black having a particle size of less than 50 mμ and not less than 35 mμ.

* * * * *